US010718530B2

(12) United States Patent
Johnson et al.

(10) Patent No.: US 10,718,530 B2
(45) Date of Patent: Jul. 21, 2020

(54) SYSTEM FOR DISTRIBUTING HOT WATER

(71) Applicant: James Johnson, Wayne, PA (US)

(72) Inventors: James Connor Johnson, Wayne, PA (US); Lucas Choi, Wayne, PA (US); Christopher Ivory, Wayne, PA (US); Samuel Kim, Wayne, PA (US); Michael Brubaker, Wayne, PA (US)

( * ) Notice: Subject to any disclaimer, the term of this patent is extended or adjusted under 35 U.S.C. 154(b) by 181 days.

(21) Appl. No.: 15/834,051

(22) Filed: Dec. 6, 2017

(65) Prior Publication Data

US 2019/0170371 A1 Jun. 6, 2019

(51) Int. Cl.

| | |
|---|---|
| ***F24D 17/00*** | (2006.01) |
| ***F24H 9/12*** | (2006.01) |
| ***F24D 19/10*** | (2006.01) |
| ***F24H 9/20*** | (2006.01) |
| ***F24H 1/18*** | (2006.01) |
| ***E03B 7/00*** | (2006.01) |

(52) U.S. Cl.

CPC ..... *F24D 17/0078* (2013.01); *E03B 7/00* (2013.01); *F24D 17/0094* (2013.01); *F24D 19/1051* (2013.01); *F24H 1/18* (2013.01); *F24H 9/126* (2013.01); *F24H 9/2007* (2013.01); *F24D 2220/0257* (2013.01)

(58) Field of Classification Search

CPC ..... F24D 17/001; F24D 17/0078; F24D 17/0094; F24D 19/1051; F24D 2220/0257; F24H 9/124; F24H 9/126; F24H 9/2007

See application file for complete search history.

(56) References Cited

U.S. PATENT DOCUMENTS

| | | | | |
|---|---|---|---|---|
| 7,036,520 | B2 * | 5/2006 | Pearson, Jr. | F24D 17/0078 126/362.1 |
| 8,191,513 | B2 * | 6/2012 | Krause | F24D 17/0078 122/20 R |
| 8,505,498 | B2 * | 8/2013 | Acker | F24D 17/0078 122/20 R |
| 9,513,019 | B2 * | 12/2016 | Acker | F24D 19/1063 |
| 2006/0230772 | A1 * | 10/2006 | Wacknov | F24D 17/00 62/199 |
| 2015/0204580 | A1 * | 7/2015 | Evans | F24H 9/2007 122/14.1 |

* cited by examiner

*Primary Examiner* — Ryan A Reis

(57) ABSTRACT

Provided is a hot water distribution system comprising a water heater, a water pump, a controller, a temperature sensor, a point-of-use, and a diverting valve capable of directing water from the water heater to either the point-of-use or back to the water heater.

20 Claims, 5 Drawing Sheets

SYSTEM FOR DISTRIBUTING HOT WATER

BACKGROUND

Fresh water is a limited natural resource and using it efficiently is essential to insuring an adequate supply is available for future generations. Agriculture, industry, and domestic populations all compete for use of limited amounts of readily available fresh water, which is less than one percent of the Earth's total water, with the remainder being salt water or water frozen in the polar ice caps. Water conservation efforts are particularly important in areas in which increasing populations and affluence place new demands on the management of water supply and distribution. To be sustainable, the amount of water withdrawn from the environment cannot exceed its natural replacement rate.

Policies for managing water as a natural resource should also consider energy conservation. Utility companies and other facilities that pump, deliver, heat, and cool water, and those that treat waste water, consume a significant amount of a country's energy production.

About 10-15 percent of total water use in the US is for domestic purposes. The US Environmental Protection Agency estimates that the average family uses more than 300 gallons of water per day at home, with roughly 70% of this being indoor use. Among the domestic indoor uses of water, 24% are for toilets, 20% are for showers, 19% are for faucets, 17% are for clothes washers, 12% are due to leaks, and 8% are for other purposes. https://www.epa.gov/watersense/how-we-use-water The average shower uses about 17 gallons of water and lasts for about eight minutes. The average household in the US has 2.5 occupants which means that each day, about 40 gallons of water are used for showers per household. Over the course of a year, showers in the US account for 1.2 trillion gallons of water use. Showers are also one of the largest uses of hot water in the home and an electric hot water heater typically accounts for about 17 percent of residential electricity usage.

There have been many efforts to improve water and energy conservation for showers including shower heads that restrict the flow of water, hot water heater with greater efficiency, and the like. Despite these efforts, a significant amount of water and energy is wasted simply waiting for showers to warm up before being used. This invention satisfies this need amongst others.

SUMMARY OF THE INVENTION

The present invention is directed to a system and method for reducing water and energy waste, such as unused heated shower water that allowed to drain while the shower water reaches an acceptable operating temperature. The invention makes efficient use of partially heated water that is typically wasted in residential applications such as showers, by creating a closed recirculation loop wherein the partially heated water is diverted from the intended point-of-use and back to a water heater. By returning the partially heated water to the water heater, the invention not only recovers water that would otherwise be lost, but also recovers energy used to heat the lost water. Importantly, the system utilizes the line pressure in the water distribution system to synergistically reduce the amount of energy required to operate the system, thus significantly improving system efficiency.

According to an aspect of the invention, provided is a system for distributing hot water comprising (a) a first conduit for channeling water from a water heater to a diverting valve, wherein the first conduit is connected to, and in fluid communication with, the water heater and the diverting valve; (b) a second conduit for channeling water from the diverting valve to a water pump, wherein the second conduit is connected to, and in fluid communication with, the diverting valve and the water pump; (c) a third conduit for channeling water from the diverting valve towards a point-of-use, wherein the third conduit is connected to, and in fluid communication with the diverting valve and at least one of (i) the point-of-use, or (i) a point-of-use valve or an additional conduit leading to the point-of-use; (d) a fourth conduit for channeling water from the water pump to water heater, wherein the fourth conduit is connected to, and in fluid communication with the water pump and the water heater; (e) a temperature sensor for measuring the temperature of water in the second conduit; and (f) a controller in electric communication with the temperature sensor, the diverting valve, and the water pump; wherein (i) the controller is effective to activate and deactivate the water pump in response to inputs from the temperature sensor, and (ii) the diverting valve is effective to divert fluid flow from the first conduit to either the second conduit or the third conduit.

According to another aspect of the invention, provided is a method for distributing hot water comprising the steps of (a) providing a system for distributing hot water as described here; (b) providing a predetermined temperature set point to the controller (c) recirculating water from the water heater to the diverting valve and back to the water heater until the predetermined temperature set point it reached; and (d) directing water from the water heater towards the point-of-use and away from the pump after the predetermined temperature set point is reached.

DETAILED DESCRIPTION OF THE INVENTION

Figure 1:
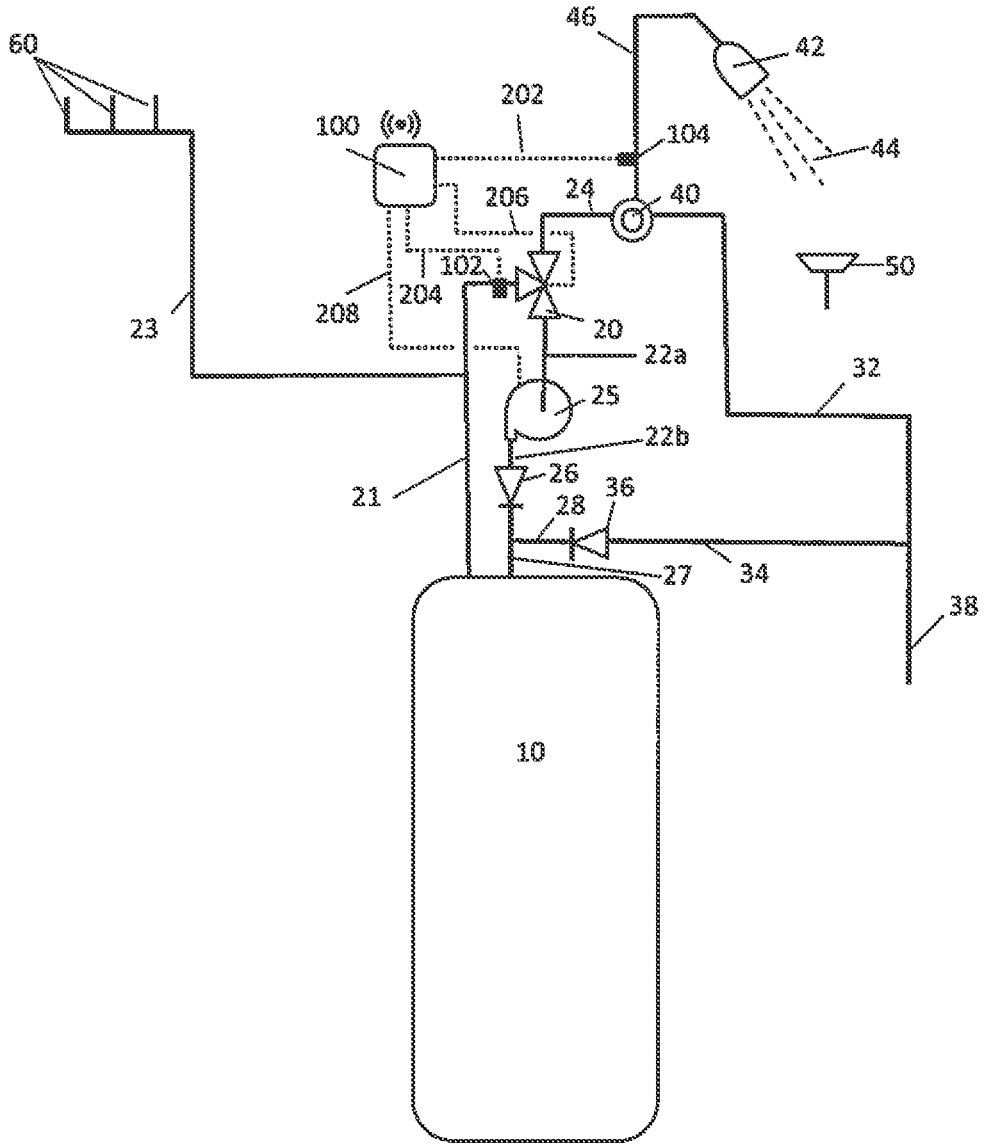
FIG. 1 is a diagram showing an example of the invention using a three-port valve.
Figure 2:
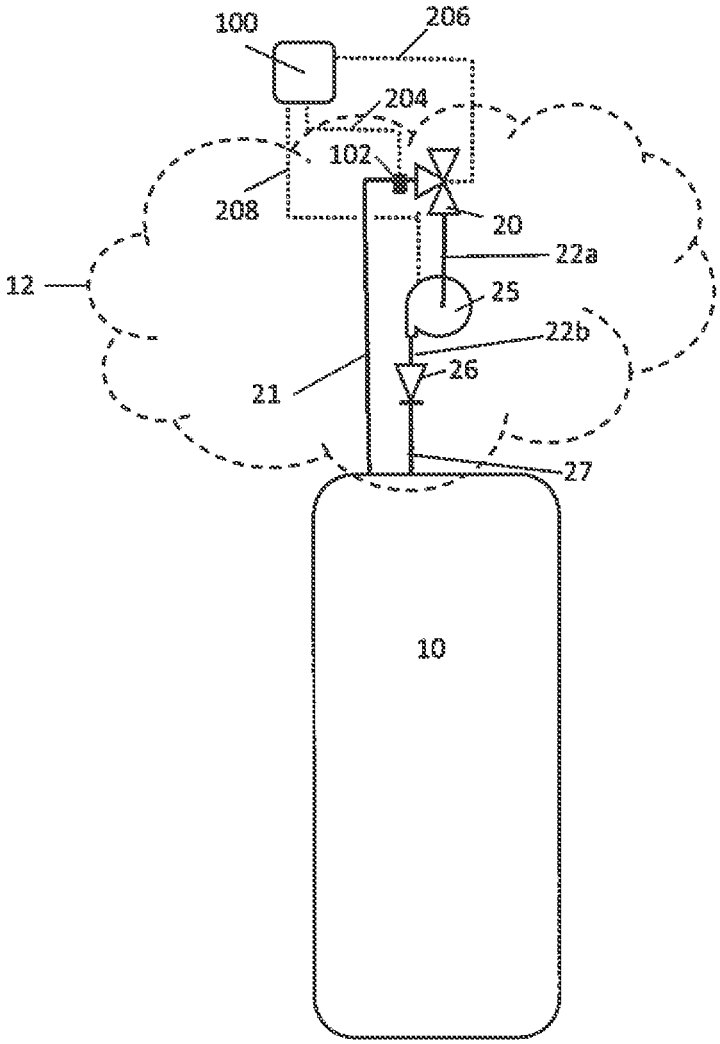
FIG. 2 is a diagram showing a closed recirculation loop according to the invention.

The hot water distribution system of the present invention reduces waste water and energy compared to conventional systems. Turning to FIG. 1, shown is an example of the invention wherein the hot water distribution system comprises a water heater 10, a water pump 25, a controller 100, a temperature sensor 102, a point-of-use 42, and a diverting valve 20 capable of directing water from the water heater 10 to either the point-of-use 42 or back to the water heater 10. The temperature sensor 102 measures the temperature of the water inside the distribution system, preferably at within the closed recirculation loop 12 (see FIG. 2), and sends an input signal 204 to the controller 100. The controller 100 uses the input signal 204 to determine whether the temperature of the water inside the distribution system is above, at, or below one or more temperature set points. If the water temperature is below a predetermined temperature set point, for example 105 degrees F., the diverting valve 20 is positioned to form a closed recirculation loop 12 with the water heater 10. (FIG.

2) If the water temperature is at or above the predetermined temperature set point, the diverting valve 20 is positioned to direct the water away from the water heater 10 and to the point-of-use 42.

When water at or above the temperature set point is desired at the point-of-use, and the water temperature inside the closed recirculation loop 12 is below the temperature set point, the controller 100 activates the water pump 25 which forces water back to the water heater 10. Importantly, the system utilizes a warm-up cycle in which water is circulated within the closed recirculation loop 12 until the water at the temperature sensor 102 reaches the temperature set point. The warm up cycle begins when the pump is activated and ends when the pump is deactivated. Unlike instant-hot systems or systems or localized water heating systems which utilize a great deal of energy to constantly maintain a high-temperature water at the point-of-use, the warm-up cycle of the present invention typically has a duration of 30 seconds to 5 minutes, more preferably less than about 3 minutes, and even more preferably less than about 1.5 minutes. In addition, unlike systems which attempt to recirculate water from outside a closed loop, e.g., at atmospheric pressure, the present invention synergistically uses the water pressure within the closed recirculation loop 12 to reduce the amount of work required of the water pump 25. More specifically, the water pressure immediately upstream 22*a* and downstream 22*b* of the water pump 25 is approximately the same, thus the pump needs to maintain only a very small head pressure to adequately move water into the water heater. Examples of required water pump head pressures are about 0.1 to 15 psi, such as 0.1 to 2 psi, 2-5 psi, 5-10 psi, and 10-15 psi. In contrast, if the return water were at atmospheric pressure, the pump's work, in addition to moving an appropriate volume of water, must include increasing the water pressure from atmospheric to at least the water pressure inside the water heater which typically ranges from about 40 to 150 psi.

Water that is recirculated to the water heater increases in temperature prior to existing the water heater. When the controller first actives the pump, the water being returned to the water heater is likely close to ambient temperature. However, as the warm-up cycle continues, water temperature within the closed recirculation loop increases, thus returning partially heated water to the water heater. This partially heated water is more efficiently heated to the temperature set point compared to heating cold water entering the water heater from outside the system, for example, from a cold-water supply line. Typically, the cold-water is external to the system is at a temperature of about 40 to 70 deg. F., such as about 50 to 60 deg. F. In contrast, at least a portion of the water being recirculated to the water heater may be about 80-100 deg. F., or more. The amount of energy required to increase the partially heated water to the temperature set point is much less than the amount of energy required to increase cold water or ambient temperature water. Accordingly, the present system is much more energy efficient compared to conventional showers in which the partially heated water is allowed to drain and is replaced by introducing cold water into the water heater.

The controller 100 can be analog or digital, but is preferably digital. The controller preferably is adapted to accept one or more inputs, preferably at least two inputs, and even more preferably at least three inputs. The controller preferably is adapted to generate one or more outputs, preferably at least two outputs, and even more preferably at least three outputs. At least a portion of the inputs and outputs are preferably electrical signals. As used herein, the term "electrical signal" and "electronic signal" are used interchangeably. Preferably, one or more inputs and/or outputs is a wireless signal, such as a radio frequency (RF) signal. At least one input is preferably generated by a temperature sensor 102, at least one input is preferably generated by the diverting valve 20 or an actuator on the diverting valve, and at least one input is generated by an input device 104, such as a binary switch or RF generating device, including a Bluetooth enabled mobile phone, table computer, mobile digital media player, or pocket computer. Preferably, at least one output is preferably an electric signal to the activate the pump 25, at least one output is to switch the position of the diverting valve 20, and at least one output is in the form of a wireless signal, such as a RF signal, or is sent to the binary switch to activate the switch or provide a user interface alert, such as an audible sound, illumination of a signal light, alarm, etc. Other input and output signals may be included as well, such as a status signal from the temperature sensor 102, diverting valve 20, or water pump 25. The controller 100 can also include one or more user interfaces, such as buttons, illuminated buttons, LED displays, mechanical switches, and the like. Preferably, the user interface provides a user with information pertaining to system dysfunctions, diagnostics, status, and programmable parameters such as temperature set points, alarms, and the like.

Figure 3:
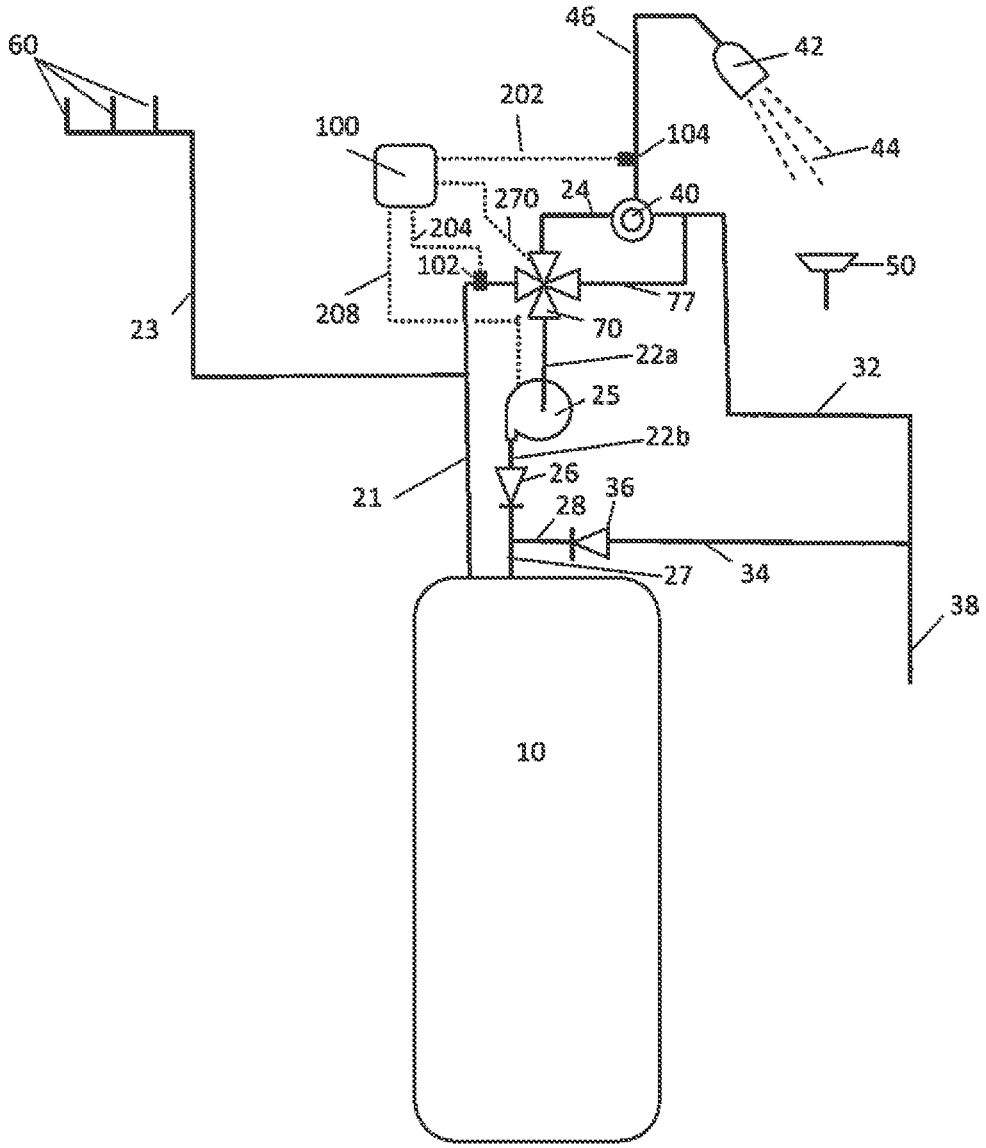
FIG. 3 is a diagram showing another example of the invention using a four-port valve.
Figure 4A:
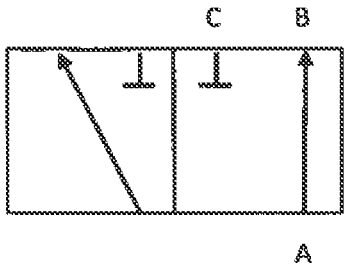
FIGS. 4*a-c* show optional solenoid valve configurations according to the invention.

The diverting valve 20 is preferably a three-port valve, a manifold with two three-port valves in series, or a four-port valve 70 (see FIG. 3). In one example of the invention, the purpose of the diverting valve 20 is to direct flowing water from the water heater 10 to a point-of-use 42, or alternatively, to divert the water to the hot water heater 10 via the water pump 25. These embodiments typically involve a three-port/two-position valve as shown in FIG. 4*a*, where port A allows receives water from the water heater, port B directs water to the point-of-use, and port C directs the water back to the water heater. In position 1, the flow is between ports A and B, whereas in position 2, the flow is between ports A and C.

In another example of the invention, as shown in FIG. 3, the purpose of the diverting valve 70 is two-fold: (1) to direct flowing water from the water heater 10 to a point-of-use 42 or to divert the water back to the water heater 10 via the water pump 25, and (2) to direct water flow from a cold-water supply line 32, through conduit 77, and into a four-port valve 70 which in electrical communication 270 with the controller 100. The purpose of the conduit 77 and four-port valve 70 is to move any residual heated water than might remain in conduits 22*a*, 22*b*, and 27 immediately following the warm-up cycle into the water heater 10 so that the heat energy can be recaptured in the water heater instead of dissipating from a stagnant water line. This is a more efficient use of energy compared to resupplying the water heater 10 using only the cold-water supply line 34. Importantly, the use of cold water from conduit 77 only occurs after the water at temperature sensor 102 has reached the temperature set point. Moreover, neither the residual hot water in conduit 22*a*, 22*b*, and 27, nor the heated water in conduit 21 enters into cold water supply lines (e.g., cold water lines to a point-of-use) and does not mix with water remaining in cold water supply lines.

Figure 4B:
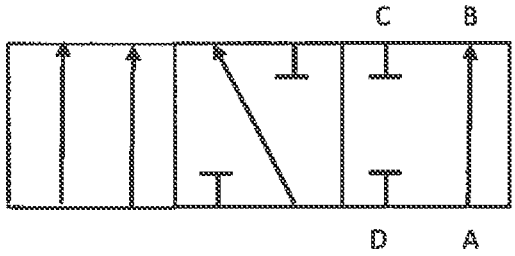
Figure 4C:
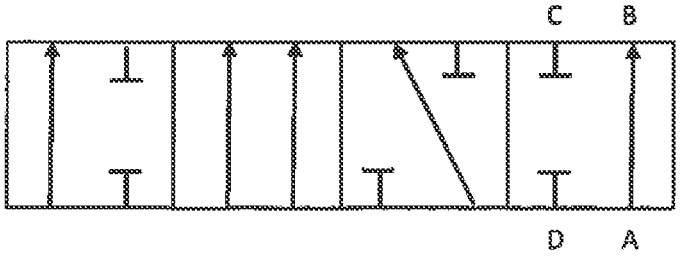

The embodiment show in FIG. 3 involves a four-port/three-position or a four-port/four-position valve. FIG. 4*b* shows a three-position, four-port valve wherein ports A, B, and C are as described above and port D allows receives water from conduit 77. Positions 1 and 2 are the same as described above, and position three allows simultaneous flow of water between ports A and B and between ports D and C. This simultaneous flow improves the response time of the system in supplying heated water to the point-of-use. FIG. 4*c* shows another embodiment of the invention using a four-port/four-position valve. In this embodiment, ports A, B, C, and D and positions 1, 2, and 3 are as described above. In position 4, ports A and B are blocked, but flow is allowed between ports D and C. This embodiment reduces potential for a pressure drop in the cold-water supply.

The type of diverting valve 20 is not particularly limited, provided that it is capable of directing the flow of water from a domestic water heater to a domestic point-of-use, such as a shower head or faucet. Acceptable types of valves include gate valves, ball valves, globe valve, diaphragm valve, butterfly valve, and plug valve. Preferably, the diverting valve is automatically actuated electromechanically, for example by a solenoid, hydraulically, or pneumatically, for example by an actuator. Preferred three-port and four-port valves are designed to direct water flow fully from one or more inlet ports to one or more outlet ports. Control valves for variable flow between one or more outlet ports are not intended for use with the present invention because variable flow between to the point-of-use and the water heater would undermine the function of the system. Likewise, proportional flow from one inlet port to two or more outlet ports would undermine the function of the system.

Highly preferred diverting valves are three-port solenoid valves, four-port solenoid valves, or two three-port valves on a manifold. Solenoid valves are preferred because they are compact, fast switching, and can be easily integrated into a control system. Preferably, the solenoid valve is biased (fail open) towards the point-of-use and is energized to redirect water to the water heater so that the point-of-use will remain functional in the event of a system failure. Preferably, the diverting valve is constructed of brass, copper, stainless steel, aluminum, or other material suitable for use for potable water. The diverting valve's size and capacity are preferably suitable for use in a domestic hot water distribution system. For example, the diverting valve preferably has a 1-inch, ¾-inch, or ½-inch ports that can be soldered or otherwise connected to convention domestic water lines such as copper tubing or PVC tubing. Preferably, the diverting valve is capable of directing water that is pressurized to between 1 and 75 psi-g, such as between 25 and 75 psi-g, and more preferably between 40 and 60 psi-g.

Check valves 26 and 36 are preferably two-port valves that restrict the flow of water to only one direction through the valve. The purposed of check valve 26 is to prevent water flow from the water heater to the pump. Check valve 26 is optional. The purpose of check valve 36 is to prevent water flow from the pump and into the cold water inlet line 34. Acceptable check valves include ball check valves, diaphragm check valves, swing or hinged check valves, or an in-line disc check valve. Preferably, the check valve is constructed of brass, copper, stainless steel, aluminum, or other material suitable for use for potable water. The check valve's size and capacity are preferably suitable for use in a domestic hot water distribution system. For example, the check valve preferably has a 1-inch, ¾-inch, or ½-inch ports that can be solders or otherwise connected to residential water lines inside a home such as copper tubing or PVC tubing. Preferably, the check valve is capable of directing water that is pressurized to between 1 and 75 psi-g, such as between 25 and 75 psi-g, and more preferably between 40 and 60 psi-g.

The temperature sensor 102 measures the temperature of the water in the closed recirculation loop 12, for example in conduit 21, and reports the temperature measurement to the controller 100 via an electrical signal 204. Preferably, the temperature sensor 102 is positioned to measure the water temperature between the diverting valve 20 and the water heater 10, such as within conduit 21. Preferably, the temperature sensor is position within 36 inches of the diverting valve 20, more preferably within 24 inches, and even more preferably within 12 inches.

The temperature sensor 102 must be able to measure temperatures within a range of 32 to 150 deg. F., more preferably from 50 to 130 deg. F., at intervals of two second or less, preferably at intervals of 1 second or less. Suitable types of temperature sensors include thermocouples, thermistors, or resistance temperature detectors (RTDs). Of these, thermistors and RTDs are preferred. Preferably, the temperature sensor 102 is in electronic communication 204 with the controller 100, although wireless signals can also be used.

The temperature sensor can be internal or external to conduit, provided that an accurate reading of water temperature is achieved. An accurate temperature reading is +/−2 deg. F., and more preferably +/−1 deg. F. If the temperature sensor is in direct contact with water inside of conduit, it must be constructed of materials that are suitable for contact with potable water.

Conduits 21, 22*a*, 22*b*, 24, and 27, as well as conduits 23, 28, 32, 34, 38, and 46 are constructed of suitable material for residential, potable water, including both hot and cold water. Examples of suitable materials include, but are not limited to, copper tubing, PCV tubing, and flex line. Suitable sizes include, but are not limited to inside diameters between ¼-inch and 1-inch, such as ½-inch, ¾-inch, and 1-inch nominal diameters. Conduits 21, 22*a*, 22*b*, and 27 are in fluid communication via one or more of diverting valve 20, pump 25, and check valve 26, to form a closed recirculation loop with the water heater 10. Conduits 22*a*, 22*b*, and 27 collectively form a return line from diverting valve 20 to the water heater 10. Preferably, the cumulative lengths of conduits 22*a*, 22*b*, and 27, i.e., the length of the return line, is less than the length of conduit 21. This is to minimize the amount of partially heated water being returned to the water heater.

Conduits 21 and 24 are connected via diverting valve 20 and are in fluid communication with one another via diverting valve 20. Collectively these two conduits form a hot water supply line for the point-of-use 42. Similarly, conduit 32 forms a cold-water supply line to the point-of-use 42. Conduits 24 and 32 are connected to, and in fluid communication, with conduit 46, optionally by way of point-of-use valve 40.

The type of point-of-use valve 40 is not particularly limited. Suitable types of valves include pressure balanced valves and thermostatic valves, provided that the valve is suitable for use in residential water systems. At point-of-use valve 40, hot water from conduit 24 and cold water from conduit 32 merge before flowing into conduit 46. Alternatively, the flow of water through conduits 24 and 32 is independently controlled by separate valves (not shown) prior to merging into conduit 46.

The point-of-use 42 can be any acceptable system for dispensing water, such as a shower head, bath tub faucet, sink faucet, spigot, or a combination systems such as a shower head and body spray, or wall-mounted shower head and rain shower head. Preferably, the point-of-use is a shower head, such as a wall-mount or hand-held shower head. In some embodiments, only a single point-of-use device is used. The shower head flow-rate can be up to 1.8 gallons per minute (GPM), up to 2.0 GPM, up to 2.5 GPM, or up to 3.5 GPM. Water 44 flowing from the point-of-use 42 is subjected to ambient pressure before entering a drain 50. The drain 50 is connect to a sewer line (not shown).

Conduit 21 is optionally connected to, and in fluid communication with, hot water distribution conduit 23, which in turn provides hot water to optional additional points-of-use 60 that are outside the present hot water distribution system. For optimum performance, the additional points of use 60 are not utilized while pump 25 is operating.

Conduits 34 and 28 collectively form a cold-water supply line to the water heater. Water from this supply line replenishes the water heater 10 as hot water is drawn from it. Conduit 34 is connected to, and is in fluid communication with, conduit 28, preferably via check valve 36, and conduit 28, in turn, is connected to, and in fluid communication with, the water heater 10. Conduit 34 optionally contains a shut-off valve (not shown). Optionally, conduit 34 are connected to, and in fluid communication with conduit 38 which supplies the residence with water from an external source, such as municipal water or well-water.

Conduit 28 is located between check valve 36 and conduit 27. To improve the efficiency of the system, particularly in terms of energy conservation, conduit 28 has a total length that is less than three times the diameter of conduit 28. In addition, the length of conduit 28 plus the radius of conduit 27 is less than six times the diameter of conduit 28. For example, if conduit 28 and conduit 27 both have a diameter of 1-inch, the preferred maximum length of conduit 28 is 3 inches. Maintaining the maximum length of conduit 28 to within these parameters improves the circulation of water within the closed recirculation loop 12.

The water heater 10 is a hot water heater suitable for residential use. Examples of suitable water heaters include both electric and natural gas hot water heaters, ranging in size from about 30 to 150 gallons. Preferred sizes range from about 40 to 80 gallons. Preferably, the water heater is capable of heating water from about 50 deg. F. to at least 100 deg. F., more preferably to at least 110 deg. F., 120 deg. F., 130 deg. F., or 140 deg. F. Particularly preferred water heaters are capable of heating 40 gallons of potable water from 55 to 120 deg. F. in about 45 to 180 minutes. Preferred water heaters have an efficiency of at least about 80%, and more preferably at least about 90%.

Input device 104 signals 202 the controller 100 that a user desires water to be dispensed from the point-of-use at the temperature set point. The temperature set point can be preprogrammed into the controller or it can be set by the use, for example via the input device 104. Acceptable temperature set points typically range from 95 to 125 degrees, more preferably from 100 to 115 degrees, such as 105 to 110 degrees. In one example, the user uses the input device 104 to signal the controller 100 to monitor the temperature of the water and if the temperature of the water is below the predetermined temperature set point, to set the diverting valve's position to create a closed recirculation loop and activate the pump 25. Once the water temperature in the close recirculation loop 12 has reached the temperature set point, the controller 100 switches the pump 25 off and the sets the diverting valve position to direct water from the water heater 10 to the point-of-use 42. Optionally, the input device 104 is equipped with output functionality and the controller 100 optionally signals the input device that the temperature set point has been reached.

Types of input devices useful in the present invention includes manual switches or button activators, that optionally include an output component. Preferably, the input device is located close to the point-of-use. In one example, the input device is integrated into point-of-use valve 40 so that setting point-of-use valve 40 to an operational position automatically generates a signal to the controller to start the warm-up cycle. Once the warm-up cycle is complete, the diverting valve 20 automatically starts the flow of water to the point-of-use.

In another example, the input device 104 is equipped to receive a signal from the controller indicating that the warm-up cycle is complete. The input device then informs the use of the status by an indicator light or audible sound. In such examples, the input device can further include a mechanism (such as a button or switch) for the user to start the flow of hot water to the point-of-use. This embodiment can further save water and energy by delaying the start of the shower until the user is ready.

In another example, the input device 104 uses wireless communication, such as Bluetooth, to signal the controller 100 to start the warm-up cycle. Typically, such devices are also capable of receiving similar types of signal so that the user can not only remotely start the warm-up cycle, but also remotely monitor the system and be alerted to any status changes. This example is also advantageous in that it allows for much greater flexibility in controlling and monitoring the system.

The water pump 25 can be any pump having sufficient capacity and suitability for residential water systems. Suitable types of pumps may include centrifugal pumps, axial flow pumps, diaphragm pumps, peristaltic pumps, positive displacement pumps, and the like. Centrifugal pumps are preferred due to their smooth operation, low power consumption, and because a high head pressure is not required.

Preferably, the pump capacity is preferably about 100 to 300 gallons per hour. The total flow is preferably at least the flow of point-of-use so that the duration of the warm-up cycle of the present invention is less than or equal to the duration of the warm-up cycle for a conventional shower. The total head pressure of the pump should not exceed maximum pressure rating of the associated water heater, for example less than 150 psi-g. Preferably, the pump's power consumption less than 100 watts, preferably less than 40 watts, more preferably less than 15 watts. Preferably, the pump uses a 110-120 VAC power input.

The controller 100 and water pump 25 are in electronic communication 208. The controller sets the water pump to run mode at the start of the warm-up cycle and switches the pump to stationary mode when the temperature set point is reached. The pump should not be place in conduit 21 because the pump does not operate when the diverting valve directs water to the point-of-use and an in-line stationary pump would unnecessarily impede the flow of heated water to the point-of-use. Since the water pump is only operational during the warm-up cycle, the water pump's duty cycle is light. Preferably, the pump has a duty cycle of 0.1 percent to less than 10 percent, and more preferably to less than 1 percent.

Example

This example demonstrates the water and energy saving made possible by the present invention compared to a conventional shower.

A conventional residential shower was operated from a cold-start. The shower components include a Speakman S-2252 Anystream shower head having a capacity of 2.5 GPM and a thermostatic shower valve. Water is supplied to the shower head from an GE 80-gallon electric hot water heater through copper tubing. The distance between the water heater and the shower head is about two-stories. The shower valve was opened to the full-hot position.

Figure 5:
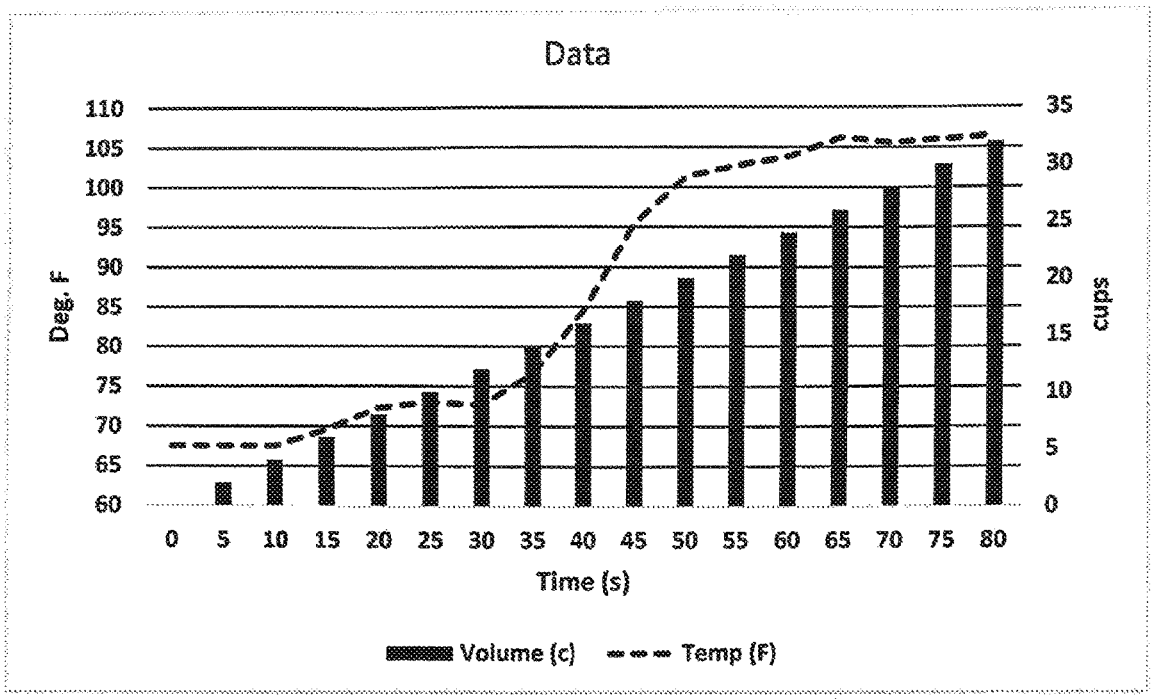
FIGS. 5 and 6 are graphs depicting data from the Examples.

All of the water exiting the shower head was collected at five second intervals as individual samples. The volume of each sample was measured. In addition, the temperature of each sample was measured. Sample collection ceased after three consecutive samples had a temperature over 100 deg. F. and had a variation in temperatures of less than 0.5 deg. The data for this study is shown in FIG. 5.

For comparison, a prophetic examples is provided wherein same shower components above will be used in combination with a four-port, four-position solenoid valve, a 10-watt centrifugal water pump positioned inline between the solenoid valve and the water heater, a copper tubing return line, a temperature sensor, and a controller. The modified shower will be operated from a cold start with the solenoid valve position to create a closed recirculation loop, followed by a flush of the residual warm water in the return line to the water heater.

Figure 6:
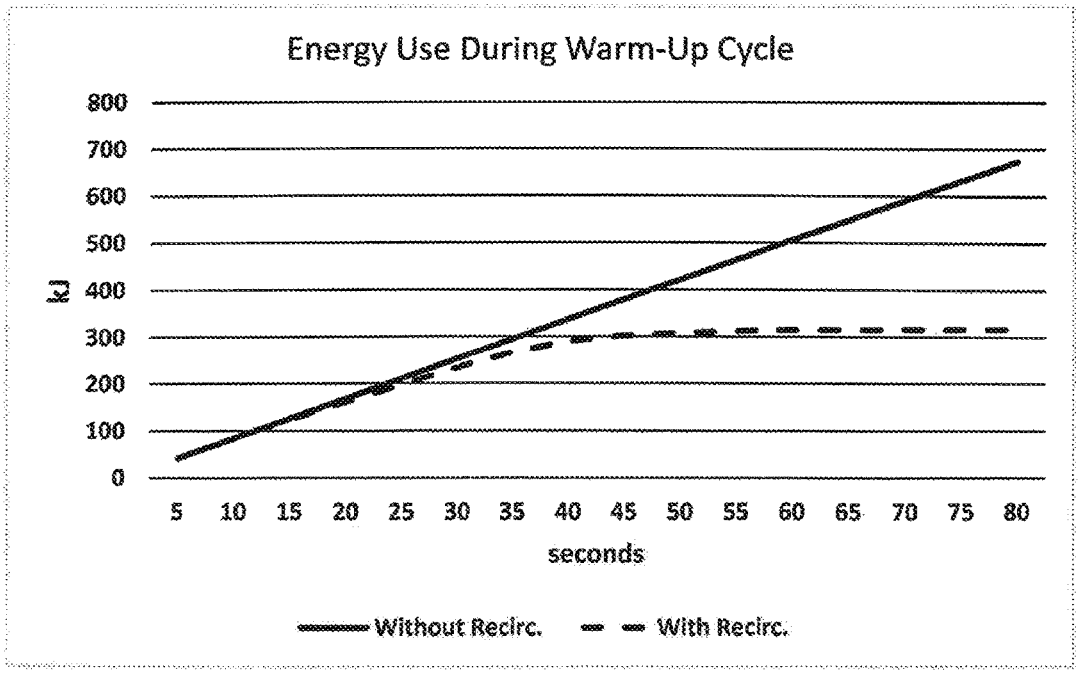

The data shown in FIG. 6 is a comparison between the energy used by the conventional shower during a warm-up period and the expected energy used by the modified shower. The conventional shower output was 464 g of water (about 2 cups) per 5 seconds. The ambient temperature of the water in the line was 19.7 deg. C. and the fully heated temperature was 41.4 deg. C. (a difference of 21.7 deg. C.). The conventional shower's energy use is calculated as the amount of energy required to heat 464 g of water 21.7 deg. C. every five seconds. The modified shower's energy use is calculated as the amount of energy required to 464 g of water 21.7 deg. C. every five seconds, less the energy saved by returning partially heated water to the water heater, plus the energy required to operate the pump. Energy used by the controller is negligible. The efficiency of the hot water heater is the same for both examples, so was not used in the calculations.

FIG. 6 shows that initially, the amount of energy savings is low because the stagnant water in the supply line that is returned to the water heater must be reheated. However, as the warm-up cycle progresses, the energy use decreases because the previously heated water is being recaptured by the water heater, and the water heater requires less energy to achieve a smaller increase in water temperature. By contrast, the conventional shower continues to use energy during the entire warm-up cycle because the partially heated water is sent to the drain and must be replaced with cold water.

In addition to saving energy, the modified shower saves about two gallons of water compared to the conventional shower.

What is claimed is:

1. A system for distributing hot water comprising:

a. a first conduit for channeling water from a water heater to a diverting valve, wherein the first conduit is connected to, and in fluid communication with, the water heater and the diverting valve;

b. a second conduit for channeling water from the diverting valve to a water pump, wherein the second conduit is connected to, and in fluid communication with, the diverting valve and the water pump;

c. a third conduit for channeling water from the diverting valve towards a point-of-use, wherein the third conduit is connected to, and in fluid communication with the diverting valve and at least one of (i) the point-of-use, (ii) a point-of-use valve, or (iii) an additional conduit leading to the point-of-use;

d. a fourth conduit for channeling water from the water pump to water heater, wherein the fourth conduit is connected to, and in fluid communication with the water pump and the water heater;

e. a temperature sensor for measuring the temperature of water in the second conduit; and f. a controller in electric communication with the temperature sensor, the diverting valve, and the water pump;

wherein the controller is effective to activate and deactivate the water pump in response to inputs from the temperature sensor, and wherein the diverting valve is effective to divert fluid flow from the first conduit to either the second conduit or the third conduit.

2. The system of claim 1, wherein the diverting valve is a solenoid valve.

3. The system of claim 1, wherein the diverting valve is a three-port/two-position solenoid valve, a four-port/three-position solenoid valve, or a four-port/four-position solenoid valve.

4. The system of claim 1, wherein the point-of-use is a shower head.

5. The system of claim 1, wherein the point-of-use is a faucet.

6. The system of claim 1, wherein the diverting valve has a position that creates a closed recirculation loop containing the water heater, the water pump, and the first, second, and fourth conduits.

7. The system of claim 6, wherein the closed recirculation loop is free of cold water supplied externally to the loop.

8. The system of claim 3, wherein the water pump capacity is 125-150% of the shower head capacity.

9. The system of claim 1, wherein the water pump is a centrifugal pump.

10. The system of claim 1, wherein the fourth conduit includes a check valve oriented to allow flow from the water pump to the water heater.

11. The system of claim 1, wherein the water heater is a residential tank-type hot water heater with a capacity of 40 to 80 gallons.

12. The system of claim 1, further comprising a first cold water conduit for resupplying the water heater with water from an external source.

13. The system of claim 1, wherein the point-of-use valve is a thermostatic valve or pressure-balance valve.

14. The system of claim 13, wherein the point-of-use valve is further connected to, and in fluid communication with, a second cold water conduit.

15. The system of claim 1, wherein the fourth conduit contains water having a temperature that is 90-100% of the temperature of water in the water heater.

16. The system of claim 15, wherein water in the water heater is maintained at a temperature of 110-150 deg. F.

17. The system of claim 1, further comprising an input device for signaling the controller to monitor the temperature of the temperature sensor, actuate the diverting valve, and operate the water pump.

18. A method for distributing hot water comprising the steps of:

a. providing a system according to claim 1;

b. providing a predetermined temperature set point to the controller;

c. recirculating water from the water heater to the diverting valve and back to the water heater until the predetermined temperature set point it reached; and d. directing water from the water heater towards the point-of-use and away from the pump after the predetermined temperature set point is reached.

19. The method of claim 18, further comprising the step:

e. pushing residual water from the fourth conduit and into the water heater between steps (c) and (d).

20. The method of claim 18 further comprising the step:

f. providing a prompt to a user that step (c) is complete.

* * * * *